US006527516B2

(12) United States Patent
Crevel

(10) Patent No.: US 6,527,516 B2
(45) Date of Patent: Mar. 4, 2003

(54) DEVICE FOR FIXING A FAN-BLADE ASSEMBLY ONTO A MOTOR SHAFT

(75) Inventor: Herve Crevel, Chatou (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/862,442

(22) Filed: May 23, 2001

(65) Prior Publication Data

US 2002/0176780 A1 Nov. 28, 2002

(51) Int. Cl.[7] ..... B63H 1/20

(52) U.S. Cl. ..... 416/204 R; 416/244 R; 403/326; 403/282

(58) Field of Search ..... 416/204 R, 244 R, 416/169 A; 403/326, 327, 329, 282, 315

(56) References Cited

U.S. PATENT DOCUMENTS

| | | | | | |
|---|---|---|---|---|---|
| 3,656,785 | A | * | 4/1972 | Lothar | 287/52.06 |
| 4,009,970 | A | | 3/1977 | Forth, Jr. | |
| 4,081,066 | A | * | 3/1978 | Ryba | 192/82 T |
| 4,189,284 | A | * | 2/1980 | Cummins | 417/313 |
| 4,197,054 | A | * | 4/1980 | Morrill | 416/93 R |
| 4,245,957 | A | * | 1/1981 | Savage et al. | 415/135 |
| 4,613,778 | A | * | 9/1986 | Wrobel et al. | 310/90 |
| 4,689,507 | A | * | 8/1987 | Baker et al. | 310/62 |
| 5,664,936 | A | * | 9/1997 | Cunha et al. | 416/204 R |

FOREIGN PATENT DOCUMENTS

| | | |
|---|---|---|
| DE | 2511507 | 9/1976 |
| DE | 9014322 | 2/1992 |
| EP | 0826884 | 3/1998 |
| FR | 2463300 | 2/1981 |
| FR | 2756021 | 5/1998 |

* cited by examiner

*Primary Examiner*—Edward K. Look
*Assistant Examiner*—James M McAleenan
(74) *Attorney, Agent, or Firm*—Liniak, Berenato & White

(57) ABSTRACT

The invention relates to a device for fixing a fan-blade assembly (10) onto a shaft (12) suitable for being driven in rotation by a motor (14). It comprises a drive hub (24) integral with the shaft (12) and suitable for serving as a support for a hub (16) of the blade assembly (10), as well as a stop ring (26) slipped on around the shaft and equipped with elastic recall means (44), so as to press the hub (16) of the fan assembly (10) elastically against the drive hub (24). Application especially to the equipment of motor vehicles.

8 Claims, 3 Drawing Sheets

DEVICE FOR FIXING A FAN-BLADE ASSEMBLY ONTO A MOTOR SHAFT

FIELD OF THE INVENTION

The invention relates to a device for fixing a fan-blade assembly onto a shaft suitable for being driven in rotation by a motor.

BACKGROUND OF THE INVENTION

A fixing device of this type finds a particular application to the equipment of motor vehicles, and especially to the fixing of a blade assembly of a motor-driven fan unit.

Such a unit makes it possible to accelerate the speed of an airflow which, for example, passes through the radiator serving for cooling a motor-vehicle engine.

Such a fan assembly, also called turbine, usually comprises a hub, also called "bowl", from which arise a plurality of blades which extend radially outwards. These blades have outer extremities which are either free, or preferably joined together by a profiled ring, also called "shroud".

Such a fan assembly is generally produced by moulding from plastic, for example from loaded polyamide, and it is fixed onto the motor shaft by fixing means of the nut-and-bolt type with the interposition of an elastic coupling produced in the form of a ring made of elastomer material or the like.

These known fixing means, however, have the drawback of not sufficiently reducing the parasitic imbalance phenomena which arise when the centre of gravity of the fan assembly is not on the rotational axis of the motor shaft.

These imbalance phenomena stem essentially from the rigidity and from the geometry of the link between the blade assembly and the motor shaft.

In particular, it has been observed that the ring made of elastomer material has a tendency to age over time and to lose its elastic properties.

This results in high levels of imbalance which generate vibration at given rotational frequencies, as well as giving rise to a reduction in the reliability of the moving parts.

Furthermore, these known fixing devices have the drawback of requiring tooling for fixing the blade assembly, which complicates assembly and manufacturing.

The object of the invention is especially to surmount the abovementioned drawbacks.

The invention aims, in particular, to obtain a device for fixing a blade assembly onto a motor shaft which makes it possible to eliminate vibration of the blade assembly by reducing the levels of imbalance.

The invention also aims to obtain a fixing device of this type which retains its properties over time.

It also aims to obtain such a fixing device which enables effective and rapid fixing of the blade assembly onto the motor shaft, without requiring special tooling.

SUMMARY OF THE INVENTION

To that end, the invention proposes a device for fixing a fan-blade assembly onto a motor shaft, which comprises a drive hub integral with the shaft and suitable for serving as a support for a hub of the blade assembly, as well as a stop ring slipped on around the shaft and equipped with elastic recall means, so as to press the hub of the fan assembly elastically against the drive hub.

It results therefrom that the blade assembly is assembled and held axially by a stop ring endowed with elastic properties, and by way of a drive hub which is integral with the shaft of the motor.

While the blade assembly is rotating, and under the dynamic effects transmitted to the structure of the blade assembly, the stop ring, because of its elastic properties, deforms and takes up the forces, which makes it possible to realign the main inertial axis of the blade assembly onto the main inertial axis of the motor shaft.

According to another characteristic of the invention, the drive hub is fixed rigidly onto the shaft.

Advantageously, the drive hub is suitable for being inserted at least partly into the hub of the blade assembly so as to make them integral in rotation via a shape-interlocking link.

In one advantageous embodiment of the invention, the drive hub comprises sectors which are offset at angles and suitable for being inserted into matching-shaped recesses which the hub of the blade assembly includes.

According to another characteristic of the invention, the elastic means for recall of the stop ring are suitable for being engaged in a groove of the shaft.

These elastic recall means advantageously comprise elastic tongues extending radially within a central aperture of the stop ring.

These elastic tongues are advantageously of generally biconical shape. In one preferred embodiment, these elastic tongues are spaced at angles and present in numbers of greater than five.

Advantageously, the stop ring is produced in a single piece from an elastically deformable material, in particular from spring steel.

BRIEF DESCRIPTION OF THE DRAWINGS

In the description which follows, given solely by way of example, reference is made to the attached drawings, on which.

DESCRIPTION OF THE PREFERRED EMBODIMENTS

Figure 1:
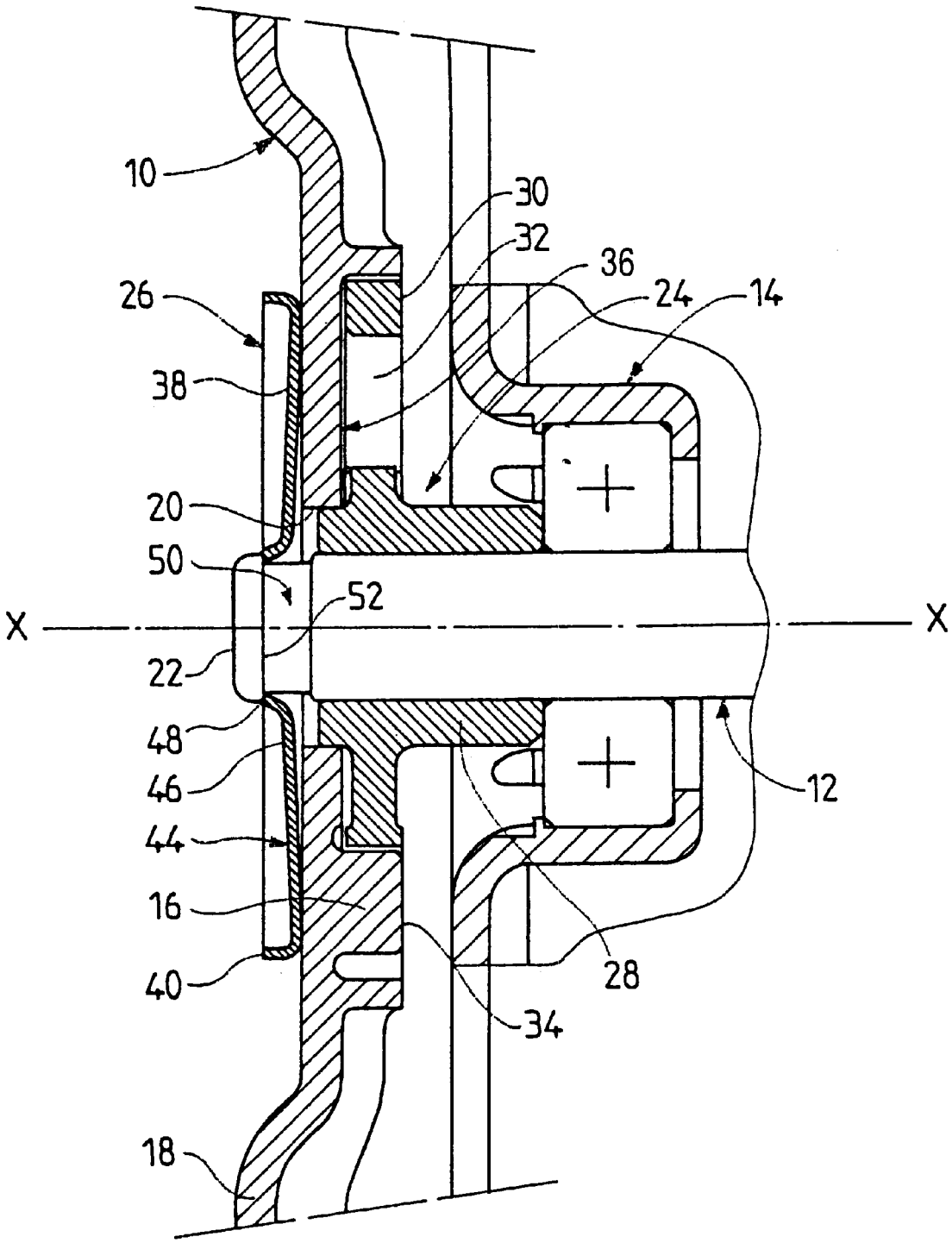
FIG. 1 is a partial view in axial section of a blade assembly fixed onto a shaft of an electric motor by way of a fixing device according to the invention.

Referring first of all to FIG. 1, a blade assembly 10 is shown (represented partially), fixed onto a shaft 12 of an electric motor 14, which is driven in rotation about an axis X—X.

In one preferred application, this blade assembly 10 forms part of a motor-driven fan unit intended to be placed in proximity to a radiator for cooling a motor-vehicle engine in order to increase the speed of an airflow which passes through this radiator.

The blade assembly 10 comprises a hub 16, also called "bowl", from which a multiplicity of blades 18 arise radially, the outer extremities (not represented) of which are either free, or preferably joined together by a shaped ring, also called "shroud".

The hub 16 of the blade assembly includes a central aperture 20 of generally circular shape which is traversed by the motor shaft 12, the latter having one extremity 22 which protrudes outwards with respect to the hub 16 of the blade assembly.

The blade assembly 10 is fixed onto the extremity of the motor shaft 12 by a fixing device according to the invention, which consists essentially of a drive hub 24 and of a stop ring 26.

The drive hub 24 is fixed rigidly onto the motor shaft 12 by appropriate mechanical means. It comprises a cylindrical barrel (FIGS. 1 and 2) capable of being pushed axially around the shaft 12 and of being secured to it in translation and in rotation by appropriate mechanical means, for example via a splined link.

This drive hub is advantageously produced from steel and it comprises from two to eight sectors 30 which extend radially outwards from the barrel 28. These sectors are three in number and are offset at angles of 120° in the example represented in FIG. 2. These sectors, which form lobes or lugs, are each formed with a gap 32 in order to lighten the drive hub 24 and reduce its moment of inertia.

The hub 16 of the blade assembly, on its inner face 34, turned towards the motor, includes recesses 36 suitable for allowing the sectors 30 of the drive hub to be embedded. The recesses 36 and the sectors 30 have matching shapes in order to allow a shape-interlocking link. Thus, when the drive hub 24 is embedded into the inner face 34 of the hub 16 of the blade assembly, a shape-interlocking link is produced which secures the blade assembly 10 in rotation on the drive hub 24 and, consequently, on the hub 12 of the motor.

The stop ring 26 contributes to the assembling and axial retention of the blade assembly by way of the drive hub 24. This stop ring 26 is formed by stamping and cutting-out a component formed in a material endowed with elastic properties. A spring-steel component is advantageously used for this purpose.

The stop ring 26 (FIGS. 1 and 2) comprises a substantially flat annular part 38 surrounded by a collar 40 and delimiting a central aperture 42 for the extremity 22 of the shaft 12 to pass through. The ring 26 is cut out in such a way as to define a plurality of elastic tongues 44 which extend radially inwards into the central aperture 42. These elastic tongues are seven in number in the embodiment of FIG. 2. They each have a generally biconical shape, that is to say they possess an outer part 46 attached to the annular part 38 forming an angle which is slightly inclined with respect to the plane of this annular part. This angle generally lies between 5 and 40°. From the outer part 46 an inner part 48 or extremity extends (FIG. 1), which is much more inclined. The elastic tongues 44 define catches the ends of which are folded and intended to interact with a groove 50 machined on the periphery of the motor shaft 12, near its extremity 22 (FIGS. 1 and 2).

Figure 2:
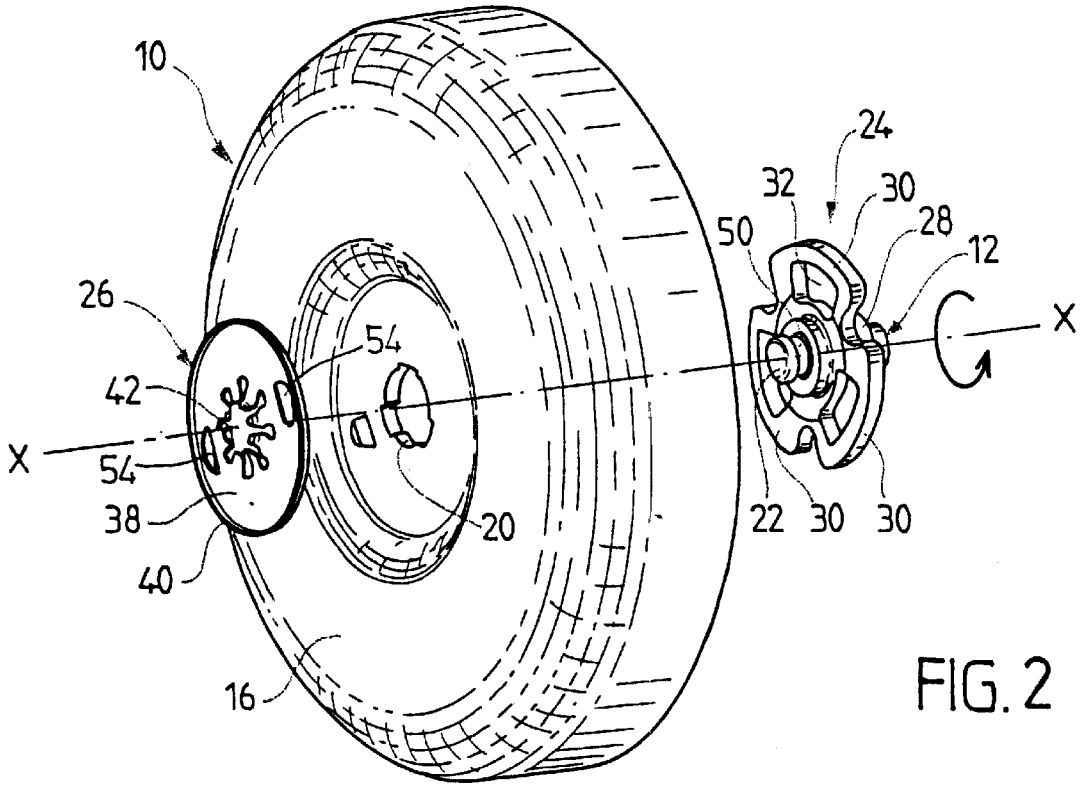
FIG. 2 is a partial view in exploded section showing a fixing device according to the invention combined with a hub of a blade assembly.

The annular part 38 preferably includes at least two gaps 54 (FIG. 2).

Figure 4:
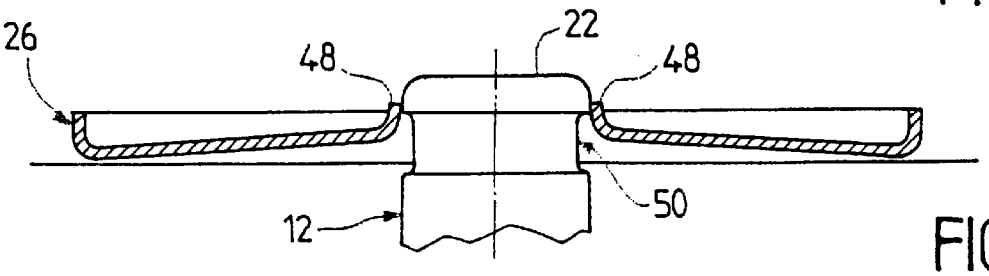
Figure 5:
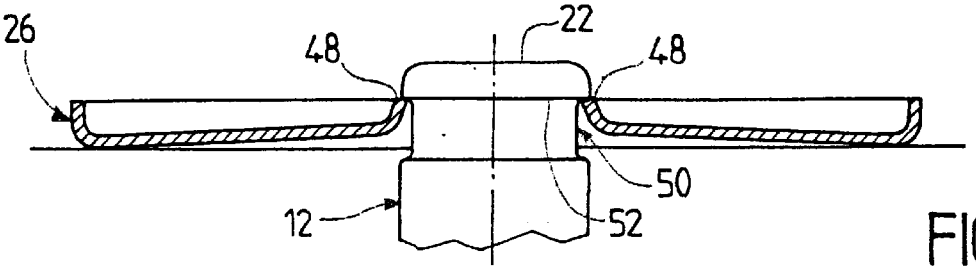

Various phases of pushing the stop ring 26 onto the extremity of the shaft 12 will now be described, by reference to FIGS. 3 to 5.

Figure 3:
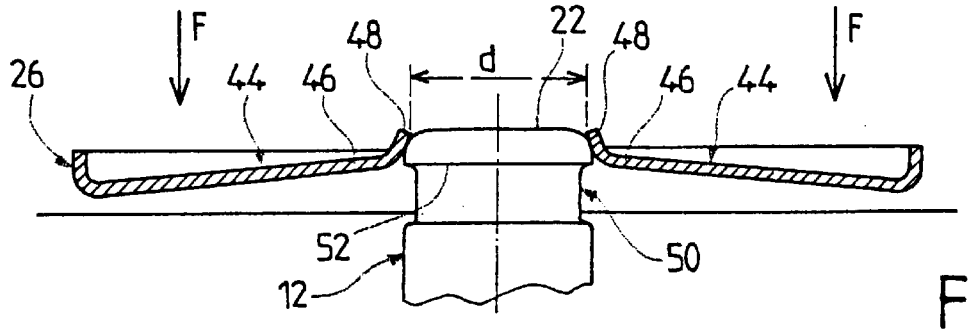
FIGS. 3 to 5 show various phases of fitting by pushing the stop ring onto the motor shaft.

As shown in FIG. 3, the ring 26 is presented facing the extremity 22 of the motor shaft. The inner parts 48 of the tongues 44 of the ring define a circular passage having a diameter d which is less than the diameter D of the shaft 12. The extremity 22 of the shaft 12 is rounded and then opens out into the groove 50. By exerting pressure on the ring 26, in the direction of the arrow F, the inner parts 48 of the tongues are progressively displaced towards the groove (FIG. 4) and then penetrate into this groove, as shown in FIG. 5. In this position, the inner parts 48 form catches which come to interact with a shoulder 52 of the groove, in order to form an anti-return lock.

It results therefrom that the blade assembly is thus assembled and held axially by the stop ring 26, via the drive hub 24. Thus centring of the blade assembly is achieved, which is obtained by a short centring lying between 1 and 4 mm, formed by the lobe-shaped sectors 30, on the drive hub. In this way, the blade assembly can be made to fit with practically zero clearance with respect to the motor shaft, and with an axial force which is generally less than 10 kg.

This results in optimised centring which makes it possible considerably to reduce the static imbalance of the blade assembly. The stop ring allows axial stopping of the blade assembly by virtue of the elastic tongues 44 which come to lodge in the groove 50.

When the blade assembly is rotating, and under the dynamic effects transmitted to the structure of the blade assembly, the elastic tongues 44 are deformed and take up the forces, thus making it possible to realign the main inertial axis of the blade assembly onto the main inertial axis of the motor shaft.

This stop ring further presents the advantage of being able to be pushed on easily without requiring special tooling, which facilitates fitting and assembling of the blade assembly on production lines.

Figure 6:
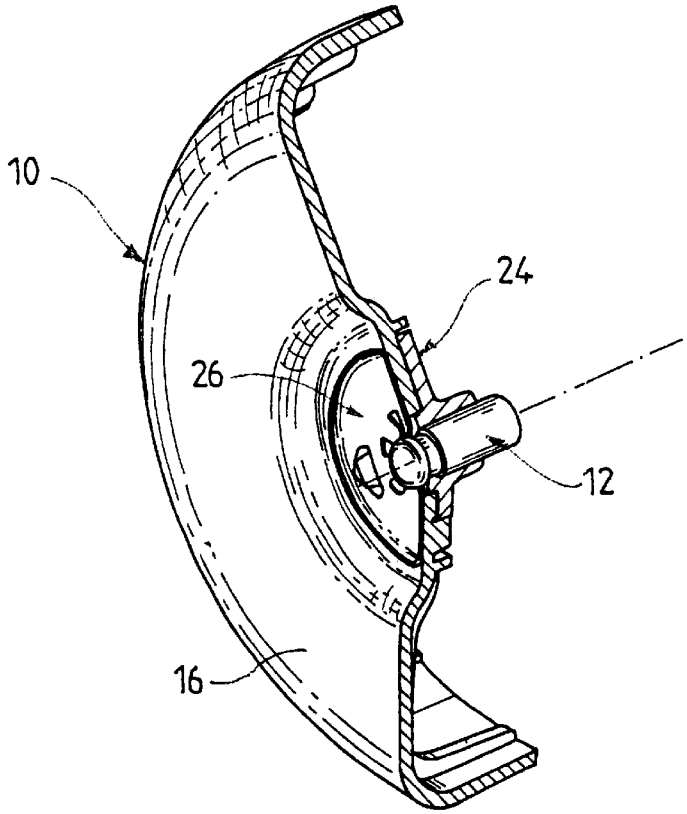
FIG. 6 is a partial view in perspective corresponding to FIG. 2 showing the device in assembled position.

FIG. 6 shows the hub of the blade assembly thus fixed onto the motor shaft by way of the device of the invention.

It will be understood that the drive hub is susceptible of many variants, as long as it is fixed rigidly onto the shaft and as long as it makes it possible to form a support with interlocking shapes with the hub of the blade assembly.

The stop ring is equally susceptible of numerous embodiment variants, as long as it includes elastic recall means suitable for interacting with the groove of the shaft of the motor.

This stop ring is preferably made from spring steel, but it could be formed from another material, including a plastic, endowed with elastic properties.

It is preferable for the number of elastic tongues to lie between five and nine.

FIGS. 7 to 12 show various embodiments of the stop ring.

Figure 7:
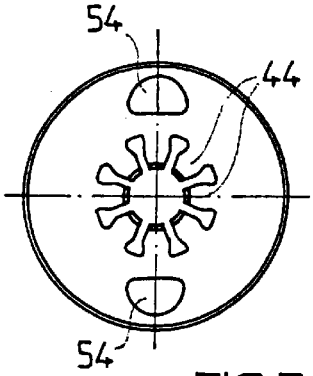
FIGS. 7 to 12 are front views of different types of stop rings which can be used in the invention.

In the case of FIG. 7, the stop ring includes eight elastic tongues 44 and two diametrally opposed gaps 54.

Figure 8:
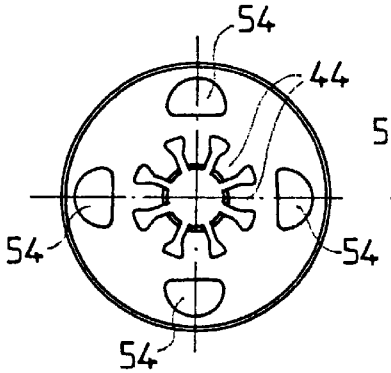

In the embodiment of FIG. 8, the stop ring also includes eight elastic tongues, but four gaps 54 spaced at angles of 90°.

Figure 9:
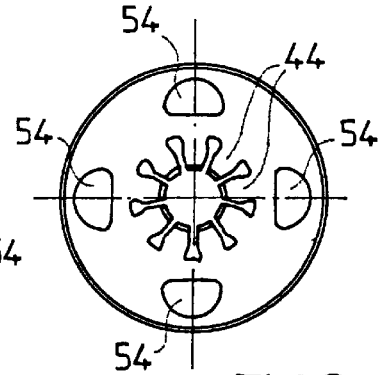

The stop ring of FIG. 9 comprises nine elastic tongues 44 and four gaps 54 spaced at angles of 90°.

Figure 10:
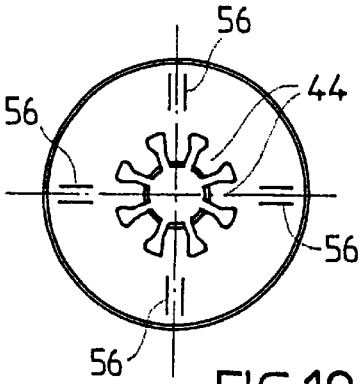

The stop ring of FIG. 10 comprises eight elastic tongues and four bosses 56 spaced at angles of 90°.

Figure 11:
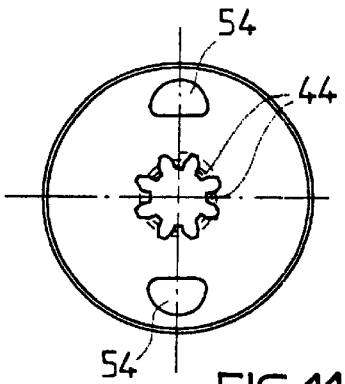

The stop ring of FIG. 11 comprises eight elastic tongues 44 which are much shorter than in the preceding embodiments, as well as two diametrally opposed gaps 54.

Figure 12:
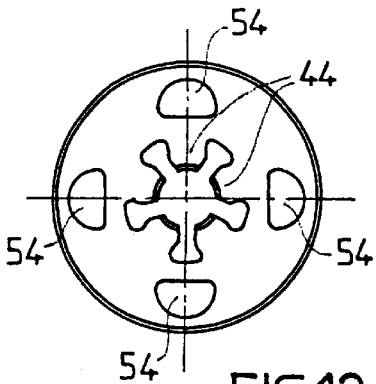

Finally, the stop ring of FIG. 12 comprises five elastic tongues 44 and four gaps 54 spaced at angles of 90°.

The invention finds a particular application to the fixing of a blade assembly of a motor-driven fan unit for a motor vehicle.

The invention is not limited to the embodiments described by way of example and extends to other variants.

Provision can especially be made for the stop ring 26 to be coated wholly or partly with a vibration-absorbing material, such as an elastomer.

Moreover, provision can be made for an elastomer ring to be interposed between the hub of the blade assembly 16 and the drive hub 24 in order to absorb vibration.

What is claimed is:

1. Device for fixing a fan-blade assembly onto a shaft suitable for being driven in rotation along a central axis by a motor, comprising a drive hub (24) integral with the shaft (12) and adapted to be a support for a hub (16) of the blade assembly (10), and a stop ring (26) slipped on around the shaft and equipped with elastic recall means (44), so as to press the hub (16) of the fan assembly (10) elastically against the drive hub (24), wherein said elastic recall means (44) abuts said hub radially outside a gap between said elastic recall means (44) and said hub, wherein the elastic means for recall of the stop ring (26) comprise a plurality of elastic tongues (44) extending radially within a central aperture (42) of the stop ring, and wherein the elastic tongues (44) are of generally biconical shape.

2. Device according to claim 1, wherein the drive hub (24) is fixed rigidly onto the shaft (12).

3. Device according to claim 1, wherein the drive hub (24) is adapted to be inserted at least partly into the hub (16) of the blade assembly so as to make them integral in rotation via a shape-interlocking link.

4. Device according to claim 3, wherein the drive hub (24) comprises a plurality of radially projecting lobes (30) which are offset at angles and suitable for being inserted into matching-shaped recesses (36) provided in the hub of the blade assembly.

5. Device according to claim 1, wherein the elastic recall means (44) for recall of the stop ring are engaged in a groove (50) of the shaft.

6. Device according to claim 1, wherein the elastic tongues (44) are spaced at angles and present in numbers of greater than five.

7. Device according to claim 1, wherein the stop ring (26) is produced in a single piece from an elastically deformable material.

8. Device according to claim 1, wherein the stop ring (26) is coated at least in part with a vibration-absorbing material.

* * * * *